US006413357B1

(12) United States Patent
Togawa et al.

(10) Patent No.: US 6,413,357 B1
(45) **Date of Patent: *Jul. 2, 2002**

(54) POLISHING APPARATUS

(75) Inventors: Tetsuji Togawa, Chigasaki; Seiji Katsuoka, Atsugi; Norio Kimura, Fujisawa; Toyomi Nishi, Yokohama, all of (JP)

(73) Assignee: Ebara Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/666,855

(22) Filed: Sep. 21, 2000

Related U.S. Application Data

(63) Continuation of application No. 08/787,916, filed on Jan. 23, 1997, now Pat. No. 6,139,677.

(30) Foreign Application Priority Data

Jan. 23, 1996 (JP) ..... 8-30072
Mar. 28, 1996 (JP) ..... 8-103532

(51) Int. Cl.[7] ..... C23F 1/02

(52) U.S. Cl. ..... 156/345; 451/72; 451/286; 451/287; 451/288

(58) Field of Search ..... 156/345; 438/691–693; 451/41, 66, 72, 285–288, 290, 455, 259

(56) References Cited

U.S. PATENT DOCUMENTS 3,000,148 A 9/1961 Bovensiepen
4,974,370 A 12/1990 Gosis
5,421,768 A 6/1995 Fujiwara et al.
5,651,725 A * 7/1997 Kikuta et al. ..... 451/41
5,653,623 A 8/1997 Kimura et al.
5,653,624 A * 8/1997 Ishikawa et al. ..... 451/287
5,655,954 A 8/1997 Oishi et al.
5,716,264 A 2/1998 Kimura et al.
5,857,898 A * 1/1999 Hiyama et al. ..... 451/56
5,896,870 A * 4/1999 Huynh et al. ..... 216/89
6,139,677 A * 10/2000 Togawa et al. ..... 156/345

FOREIGN PATENT DOCUMENTS

EP 0335752 10/1989
EP 0566258 10/1993
EP 581350 A1 2/1994
EP 0658400 6/1995
JP 62-22055 2/1987
JP 7223142 8/1995

* cited by examiner

*Primary Examiner*—Benjamin L. Utech
*Assistant Examiner*—Duy-Vu Deo
(74) *Attorney, Agent, or Firm*—Wenderoth, Lind & Ponack, L.L.P.

(57) ABSTRACT

A polishing apparatus is used for polishing a workpiece such as a semiconductor wafer to a flat mirror finish by a combination of chemical polishing and mechanical polishing. The polishing apparatus includes a turntable with a polishing cloth mounted on an upper surface thereof, a top ring for supporting the workpiece to be polished and pressing the workpiece against the polishing cloth, and a dressing tool for dressing the polishing cloth on the turntable. The polishing apparatus further includes a cover which covers an upper surface of the turntable for preventing liquid on the turntable from being scattered, and inserting holes formed in an upper wall of the cover for inserting the top ring and the dressing tool therethrough.

2 Claims, 8 Drawing Sheets

POLISHING APPARATUS

This is a Continuation Application of parent Ser. No. 08/787,916, filed Jan. 23, 1997 now U.S. Pat. No. 6,139,677.

BACKGROUND OF THE INVENTION

1. Field of the Invention

The present invention relates to a polishing apparatus for polishing a workpiece such as a semiconductor wafer to a flat mirror finish, and more particularly to a polishing apparatus having a cover which prevents liquid on a turntable from being scattered.

2. Description of the Related Art

Recent rapid progress in semiconductor device integration demands smaller and smaller wiring patterns or interconnections and also narrower spaces between interconnections which connect active areas. One of the processes available for forming such interconnections is photolithography. Though the photolithographic process can form interconnections that are at most 0.5 $\mu$m wide, it requires that surfaces on which pattern images are to be focused by a stepper be as flat as possible because the depth of focus of the optical system is relatively small.

It is therefore necessary to make the surfaces of semiconductor wafers flat for photolithography. One customary way of flattening the surfaces of semiconductor wafers is to polish them with a polishing apparatus.

Conventionally, a polishing apparatus has a turntable and a top ring which rotate at respective individual speeds. A polishing cloth is attached to the upper surface of the turntable. A semiconductor wafer to be polished is placed on the polishing cloth and clamped between the top ring and the turntable. An abrasive liquid containing abrasive grains is supplied onto the polishing cloth and retained on the polishing cloth. During operation, the top ring exerts a certain pressure on the turntable, and the surface of the semiconductor wafer held against the polishing cloth is therefore polished by a combination of chemical polishing and mechanical polishing to a flat mirror finish while the top ring and the turntable are rotated.

After, for example, one or more semiconductor wafers have been polished, the polishing cloth is processed to recover its original polishing capability. Various processes have been and are being developed for restoring the polishing cloth, and are collectively called "dressing". The polishing cloth is dressed in order to enable the polishing apparatus to perform a good polishing function at all times without undesired degradation of a polishing performance.

When polishing semiconductor wafers or dressing the polishing cloth, an abrasive liquid or a deionized water (pure water) is supplied onto the polishing cloth on the turntable in the vicinity of the top ring, and hence the abrasive liquid or the deionized water tends to be scattered around because the turntable and the top ring are rotated.

On the other hand, when the polishing apparatus is used in a clean room for manufacturing semiconductor devices, it is necessary to enclose the polishing apparatus by partition walls so that the abrasive liquid or the deionized water is not scattered in the clean room. However, since the scattered abrasive liquid or the like adheres to the partition walls, troublesome cleaning of the partition walls is required, and various equipments such as driving devices for the top ring and the dressing tool are adversely affected by the scattered abrasive liquid.

SUMMARY OF THE INVENTION

It is therefore an object of the present invention to provide a polishing apparatus in which an abrasive liquid or a dressing liquid such as a deionized water supplied to a polishing cloth on a turntable is not scattered around, and can be effectively discharged therefrom to the exterior of the apparatus. The polishing apparatus is provided with a cover for the turntable which has a high strength and a high productivity.

According to the present invention, there is provided a polishing apparatus for polishing a surface of a workpiece comprising: a turntable having a polishing surface; a top ring for supporting the workpiece to be polished and pressing the workpiece against the polishing cloth; a dressing tool for dressing the polishing surface on the turntable; a cover which covers an upper surface of the turntable for preventing liquid on the turntable from being scattered, the cover being made of synthetic resin and having an upper wall and a side wall; and inserting holes formed in the upper wall of the cover for inserting the top ring and the dressing tool therethrough.

According to the present invention, since the abrasive liquid or the dressing liquid such as deionized water is not scattered in the clean room in which the polishing apparatus is installed, cleaning of the room is not required, and the driving devices for driving the top ring and the dressing tool are not adversely affected.

In a preferred embodiment of the present invention, the cover for the turntable is formed by a single plate made of synthetic resin.

With the above arrangement, since the cover is formed by a single plate made of synthetic resin, the cover has a high strength and light weight. Therefore, handling of the cover is easy, and material cost thereof can be greatly reduced. Further, the time required to manufacture the cover can be greatly reduced, and the manufacturing cost thereof can be also greatly reduced. Furthermore, since the same dies can be used to manufacture the cover, accuracy of shape and dimension of the cover can be ensured.

In a preferred embodiment of the present invention, the polishing apparatus further comprises a trough disposed around the turntable for receiving liquid discharged from the turntable, and an exhaust duct connected to the trough for exhausting gas in the cover.

With the above arrangement, when the cover is removed from the turntable or attached to the turntable, detachment or attachment of the exhaust duct is not required, and hence the maintenance of the turntable can be easily performed.

The above and other objects, features, and advantages of the present invention will become apparent from the following description of illustrative embodiments thereof in conjunction with the accompanying drawings.

DETAILED DESCRIPTION OF THE PREFERRED EMBODIMENTS

A polishing apparatus according to a first embodiment of the present invention will be described below with reference to FIGS. 1 through 5.

Figure 1:
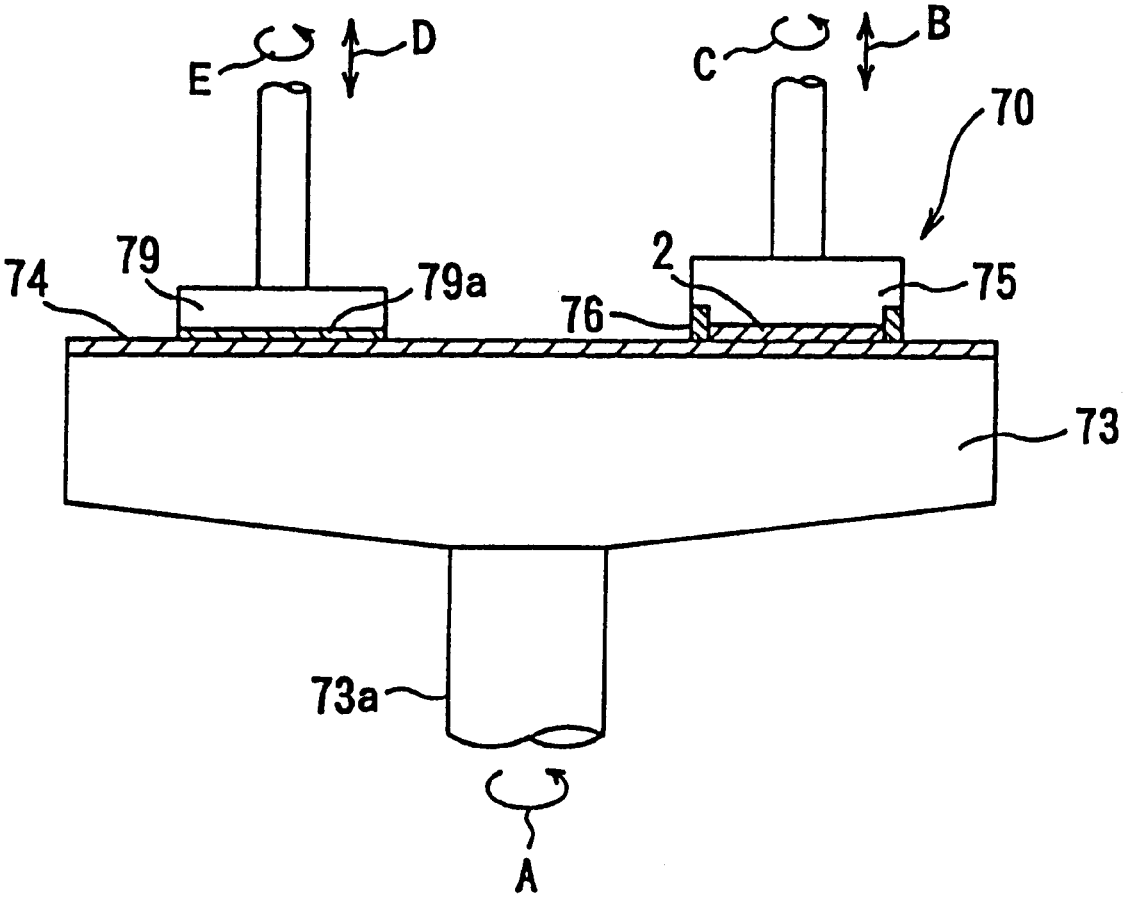
FIG. 1 is a vertical cross-sectional view of a polishing apparatus from which a cover for a turntable is removed according to a first embodiment of the present invention.
Figure 2:
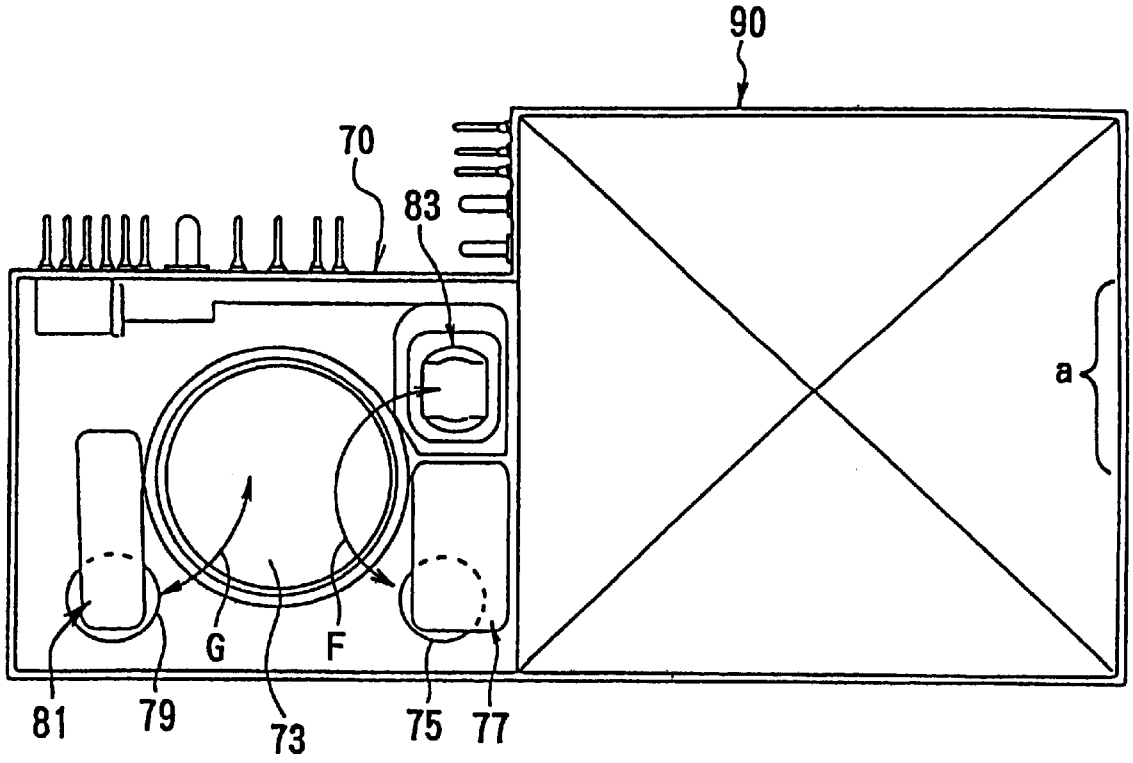
FIG. 2 is a plan view of a polishing apparatus from which a cover for a turntable is removed according to the first embodiment of the present invention.

A basic structure of a polishing apparatus will be described with reference to FIGS. 1 and 2. FIGS. 1 and 2 show a polishing apparatus from which a cover for a turntable is removed. As shown in FIG. 1, a polishing apparatus 70 comprises a turntable 73, and a top ring 75 positioned above the turntable 73 for holding a semiconductor wafer 2 against the turntable 73. The top ring 75 is located in an off-center position with respect to the turntable 73. The turntable 73 is rotatable about its own axis as indicated by the arrow A by a motor (not shown) which is coupled through a shaft 73*a* to the turntable 73. A polishing cloth 74 is attached to an upper surface of the turntable 73.

The top ring 75 is coupled to a motor (not shown) and also to a lifting/lowering cylinder (not shown). The top ring 75 is vertically movable and rotatable about its own axis as indicated by the arrows B, C by the motor and the lifting/lowering cylinder. The top ring 75 can therefore press the semiconductor wafer 2 against the polishing cloth 74 under a desired pressure. The semiconductor wafer 2 is attached to a lower surface of the top ring 75 under a vacuum or the like. A guide ring 76 is mounted on the outer circumferential edge of the lower surface of the top ring 75 for preventing the semiconductor wafer 2 from being disengaged from the top ring 75.

A dressing unit comprises a dressing tool 79 which is positioned above the turntable 73 in diametrically opposite relation to the top ring 75. The dressing tool 79 is coupled to a motor (not shown) and also to a lifting/lowering cylinder (not shown). The dressing tool 79 is vertically movable and rotatable about its own axis as indicated by the arrows D, E by the motor and the lifting/lowering cylinder. The dressing tool 79 has a dressing layer 79*a* composed of, for example, a diamond grain layer containing diamond grains on its lower surface.

As shown in FIG. 2, the polishing apparatus 70 comprises the turntable 73 at a central part thereof, a polishing unit 77 including the top ring 75, a dressing unit 81 including the dressing tool 79, and a workpiece transferring device 83 disposed adjacent to the polishing unit 77. A transporting and cleaning device 90 is provided adjacent to the polishing apparatus 70. The transporting and cleaning device 90 has a workpiece transporting robot, a cleaning device, and a drying device therein (not shown in FIG. 2).

A semiconductor wafer 2 (see FIG.1) is supplied to a receiving section "a" of the transporting and cleaning device 90, and then transported to the workpiece transferring device 83 of the polishing apparatus 70 by the workpiece transporting robot in the transporting and cleaning device 90. The semiconductor wafer on the workpiece transferring device 83 is transferred to the top ring 75 of the polishing unit 77 which has been swung as shown by an arrow F, and then the semiconductor wafer held by the top ring 75 is polished on the turntable 73. Thereafter, the semiconductor wafer is returned to the workpiece transferring device 83, and transported to the cleaning device by the workpiece transporting robot in the transporting and cleaning device 90, and then dried by the drying device in the transporting and cleaning device 90. The semiconductor wafer is transported to the receiving section "a" after it is dried, and then discharged therefrom to the exterior of the apparatus.

The dressing tool 79 is swung as shown by an arrow G to position the dressing tool 79 above the turntable 73, and pressed against the polishing cloth 74 (see FIG. 1) to thus dress the polishing cloth 74 on the turntable 73.

Figure 3:
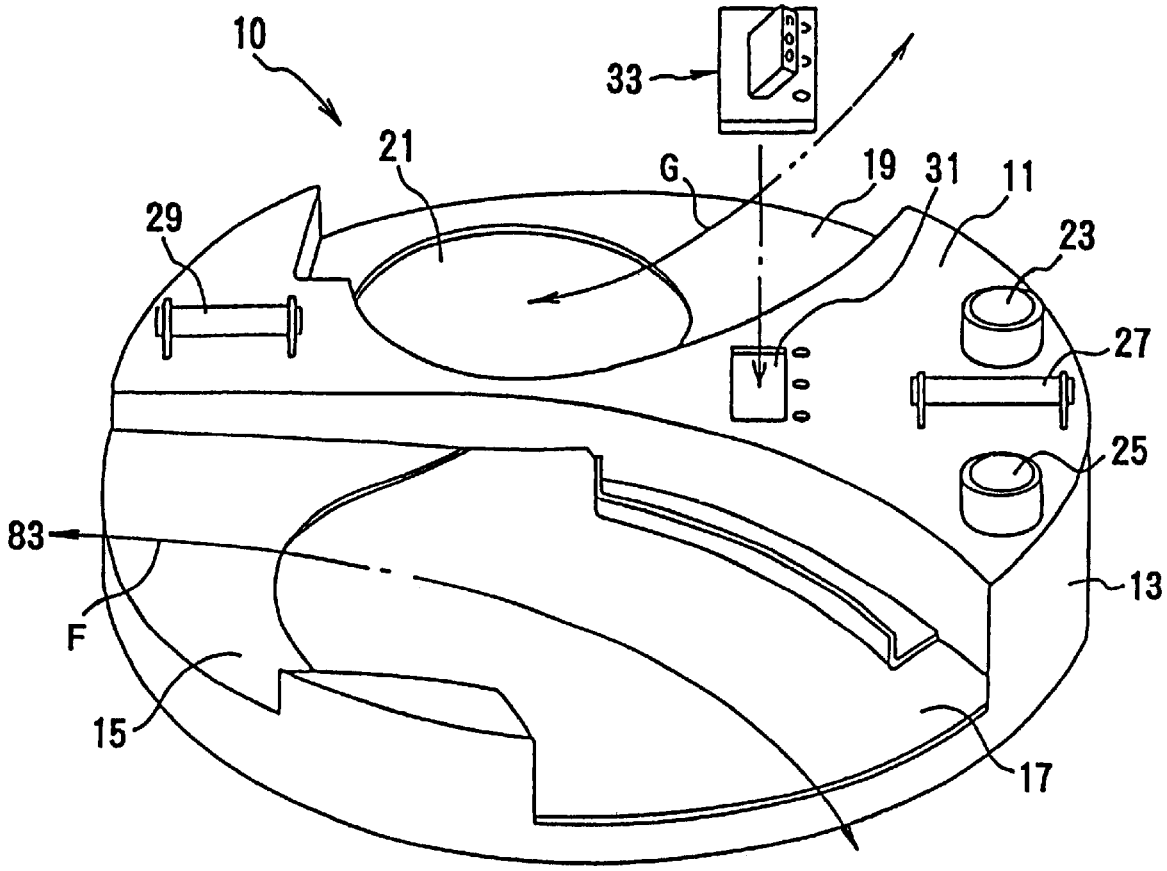
FIG. 3 is a perspective view of a cover for a turntable in a polishing apparatus according to the first embodiment of the present invention.

According to the present invention, a cover 10 for the turntable 73 is provided to prevent liquid on the turntable 73 from being scattered. As shown in FIG. 3, the cover 10 made of synthetic resin has an upper wall 11 and a cylindrical side wall 13 extending downwardly from an outer periphery of the upper wall 11. The cover 10 has an outside diameter slightly larger than an outside diameter of the turntable 73 to cover an entire upper surface of the turntable 73. The cover 10 has a substantially circular arc-shaped recess 15 for allowing the top ring 75 to pass therethrough, and a substantially semicircular recess 19 for allowing the dressing tool 79 to pass therethrough. The recess 19 may be a substantially circular arc-shaped recess. In the recesses 15 and 19, respective inserting holes 17 and 21 are formed. The inserting holes 17 and 21 allow the top ring 75 and the dressing tool 79 to be inserted, respectively, therethrough. The top ring 75 is horizontally movable from the central portion of the turntable to the outer periphery thereof in the inserting hole 17 after the top ring 75 is inserted in the hole 17. The upper wall 11 has two cylindrical exhaust holes 23 and 25, and grips 27 and 29 fixed thereto. Further, the upper wall 11 has an opening 31 for supplying an abrasive liquid containing abrasive material, and a dressing liquid such as a deionized water. A nozzle unit 33 is removably attached to the upper wall 11 of the cover 10 at the location of the opening 31.

Figure 4:
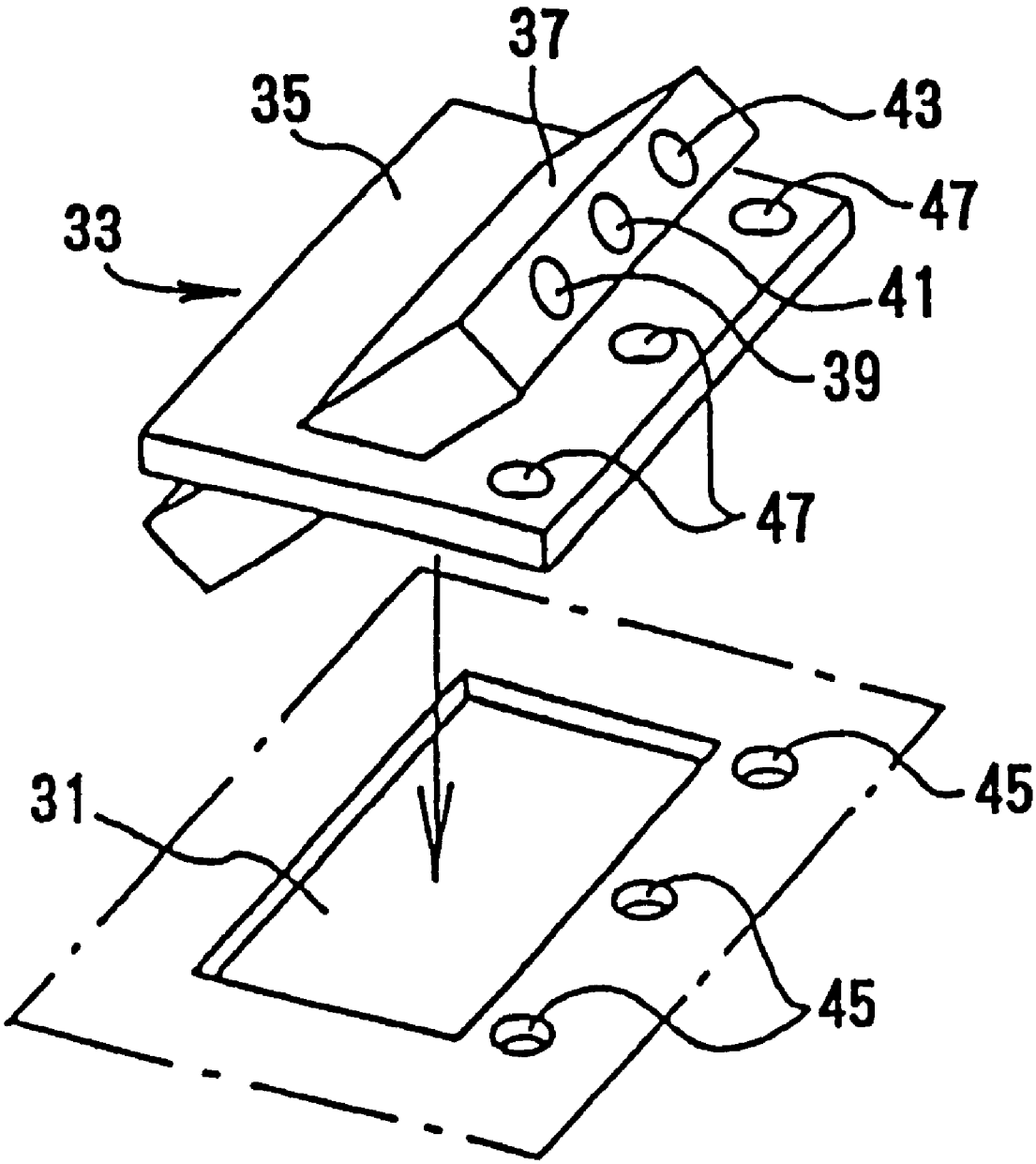
FIG. 4 is a perspective view showing an opening formed in the cover and a nozzle unit attached to the cover according to the first embodiment of the present invention.

FIG. 4 shows the opening 31 formed in the cover 10 and the nozzle unit 33 to be attached to the cover 10. As shown in FIG. 4, the nozzle unit 33 comprises a flat base plate 35, and a nozzle body 37 having a rectangular parallelepiped-shape which pierces the flat base plate 35 obliquely. The nozzle body 37 has three nozzles 39, 41 and 43 whose upper ends have respective female threads (not shown). Mounting holes 45 are formed adjacent to the opening 31 in the upper wall 11, and mounting holes 47 are formed in the base plate 35 in registry with the mounting holes 45. The nozzle unit 33 is removably attached to the upper wall 11 at the location of the opening 31 by fixing means such as bolts which are inserted into the mounting holes 45 and 47. The forward ends of abrasive liquid supply pipes (not shown) are inserted into the two nozzles 39 and 41 of the nozzle unit 33, and the forward end of a dressing liquid supply pipe (not shown) is connected to the nozzle 43 of the nozzle unit 33.

The cover 10 shown in FIG. 3 is formed by pressing a chloroethylene plate having a thickness of 3 mm between male and female dies while heating the chloroethylene plate. The grips 27 and 29 and the nozzle unit 33 are attached to the upper wall 11 of the cover 10 after forming of the cover 10. Since the nozzle unit 33 has a removable structure, the nozzle unit 33 can be removed from the cover 10 at the time of maintenance of the turntable 73 and the polishing unit 77, thus facilitating maintenance operations.

As described above, in the case where the cover 10 is formed by a single plate made of synthetic resin, the manufacture of the cover 10 is much easier than that of the cover which is formed by a plurality of chloroethylene plates through welding and bending. Further, since there is no adhesive portion in the cover 10, the cover 10 has a high flexibility and a high impact resistance. Therefore, in case of forming the cover by a plurality of chloroethylene plates through welding and bending, it is necessary to use chloroethylene plates having a thickness of about 5 mm.

However, in this case, a synthetic resin plate having a thickness of 3 mm is sufficient to form the cover 10, the cover can be lighter to thus be easily handled, and material cost of the cover can be reduced. The time required to manufacture the cover can be greatly reduced, and the manufacturing cost thereof can be also greatly reduced. Further, since the same dies can be used to manufacture the cover, accuracy of shape and dimension of the cover can be ensured.

Figure 5:
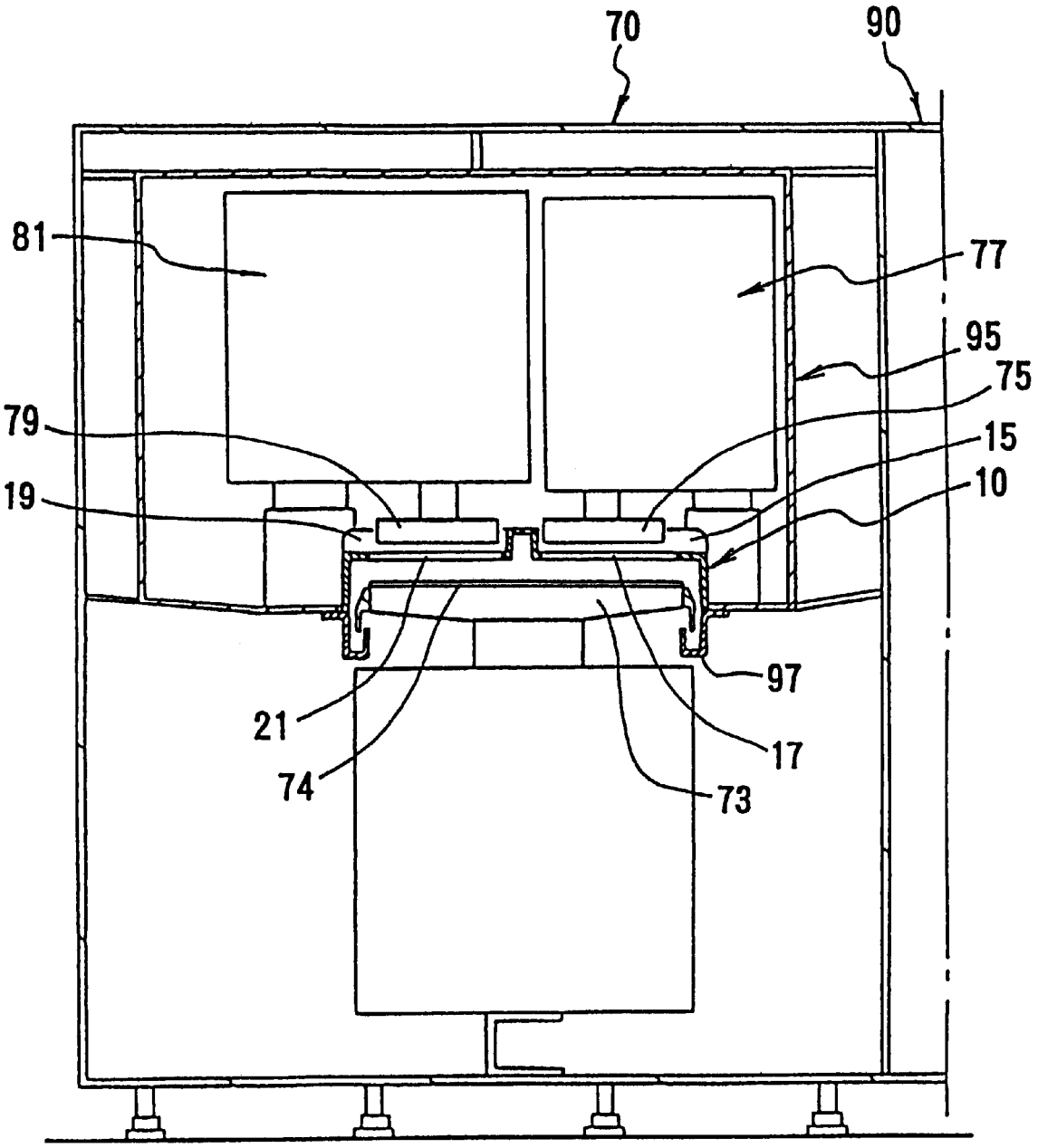
FIG. 5 is a vertical cross-sectional view of a polishing apparatus having a cover for a turntable according to the first embodiment of the present invention.

FIG. 5 shows the cover 10 which is installed in the polishing apparatus. As shown in FIG. 5, the cover 10 is provided so as to cover the entire upper surface of the turntable 73. The outer periphery of the cover 10 is fixed to the lower end of a housing 95. The housing 95 is provided so as to enclose the overall arrangement of the cover 10, the polishing unit 77 and the dressing unit 81. The housing 95 is formed by a single plate made of chloroethylene in the same manner as the cover 10. Therefore, the housing 95 has the same effect as the cover 10 such as a high strength or a high productivity. An annular trough 97 for receiving an abrasive liquid or a dressing liquid such as a deionized water discharged from the turntable 73 is provided below the outer periphery of the turntable 73.

As described above, two nozzles for the abrasive liquid supply pipes and one nozzle for the dressing liquid supply pipe are connected to the nozzle unit 33. Exhaust ducts (not shown) are connected to the exhaust holes 23 and 25 of the cover 10, respectively. Further; an exhaust duct (not shown) is connected to the housing 95 at a required position.

Next, the operation of the cover 10 will be described below. In FIG. 2, the semiconductor wafer on the workpiece transferring device 83 is transferred to the top ring 75 which has been swung as shown by an arrow F, and the top ring 75 holding the semiconductor wafer is moved into the recess 15 of the cover 10, and then inserted into the inserting hole 17 (see FIG. 3). Thereafter, the semiconductor wafer is pressed against the polishing cloth 74 on the turntable 73 and polished while the turntable 73 and the top ring 75 are rotated (see FIG. 1).

At this time, the abrasive liquid is being supplied from the nozzle unit 33 to the polishing cloth 74, and air or gas generated in the polishing process in the cover 10 is exhausted through the exhaust ducts which are attached to the exhaust holes 23 and 25 of the cover 10. During polishing, the abrasive liquid on the turntable 73 is scattered around in the form of water drops or mist, but most of water drops or mist adhere to the inner surface of the cover 10, and are prevented from being discharged therefrom. Thus, water drops or mist are discharged through the trough 97 to the exterior of the apparatus. Although the cover 10 has the inserting holes 17 and 21, since negative pressure is developed in the cover 10 due to air stream through the exhaust ducts attached to the exhaust holes 23 and 25, water drops or mist do not flow out through the inserting holes 17 and 21, and are discharged through the exhaust ducts to the exterior of the apparatus. As shown in FIG. 5, since the cover 10 is enclosed by the housing 95, even if mist escapes through the inserting holes 17 and 21 and the like, it is discharged through the exhaust duct (not shown) connected to the housing 95, to the exterior of the apparatus.

On the other hand, in case of dressing the polishing cloth 74 on the turntable 73 after polishing, the dressing tool 79 is moved as shown by the arrow G in FIG. 2 to thus be positioned in the recess 19 of the cover 10, and then inserted into the inserting hole 21 of the cover 10. Thus, the dressing tool 79 having the dressing layer 79*a* is pressed against the polishing cloth 74 on the turntable 73, and the polishing cloth 74 is dressed while the turntable 73 and the dressing tool 79 are rotated (see FIG. 1). At this time, although a dressing liquid such as a deionized water is supplied from the nozzle unit 33 to the polishing cloth 74, it is hardly discharged to the exterior of the cover 10 in the same manner as the abrasive liquid, and it is completely prevented from being scattered to the outside of the apparatus due to the presence of the housing 95. Therefore, the interior of the clean room in which the polishing apparatus 70 is installed is not polluted by the abrasive liquid, the dressing liquid or the like.

As described above, the first embodiment of the present invention offers the following advantages:

1) Since the abrasive liquid or the dressing liquid such as a deionized water is not scattered in the clean room in which the polishing apparatus is installed, cleaning of the room is not required, and the driving devices for driving the top ring and the dressing tool ate not adversely affected.

2) Since the cover is formed by a single plate made of synthetic resin, the cover has a high strength and is light weight. Therefore, handling of the cover is easy, and material cost thereof can be greatly reduced. Further, the time required to manufacture the cover can be greatly reduced, and the manufacturing cost thereof can be also greatly reduced. Furthermore, since the same dies can be used to manufacture the cover, accuracy of shape and dimension of the cover can be ensured.

3) Since an opening for supplying the abrasive liquid and the dressing liquid is formed in the cover at a specified position, and the nozzle unit for connecting the abrasive liquid supply pipe and the dressing liquid supply pipe thereto is removably attached to the cover, the installation of the nozzles for the abrasive liquid supply pipe and the dressing liquid supply pipe can be easily and reliably carried out.

Next, a second embodiment of the present invention will be described below with reference to FIGS. 6 and 7.

Figure 6:
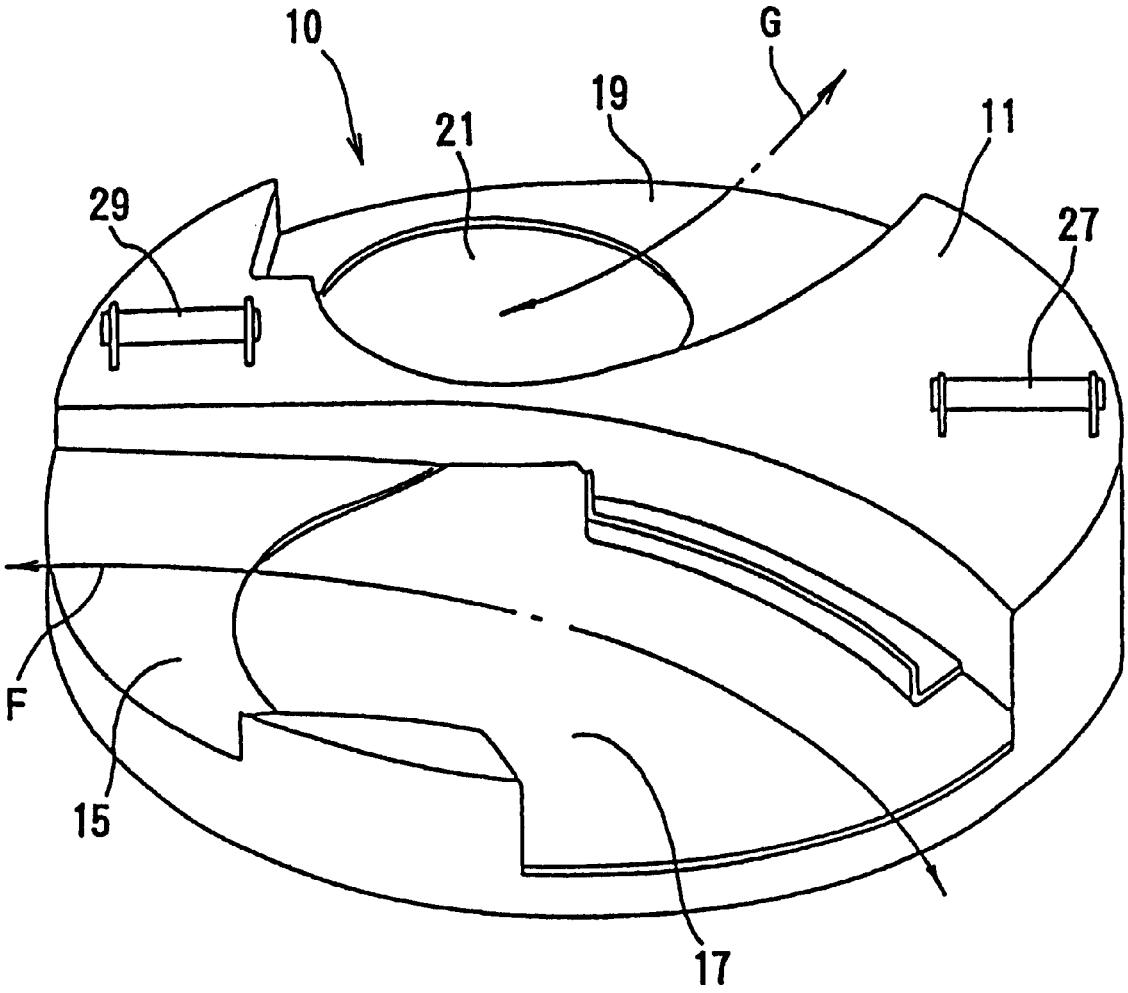
FIG. 6 is a perspective view of a cover for a turntable in a polishing apparatus according to a second embodiment of the present invention.
Figure 7:
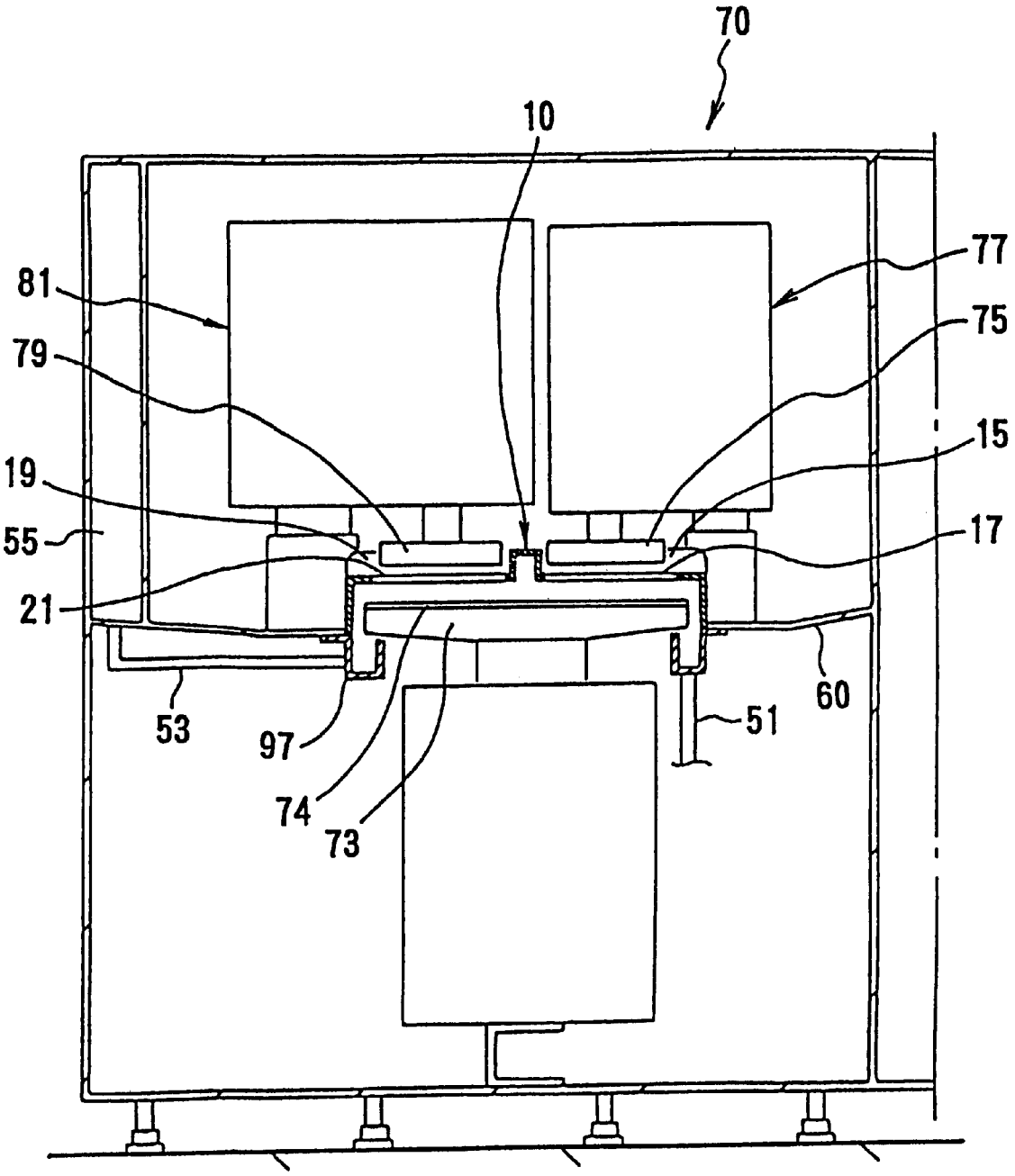
FIG. 7 is a vertical cross-sectional view of a polishing apparatus having a cover for a turntable according to the second embodiment of the present invention.

FIG. 6 shows a cover 10 of the second embodiment, and FIG.7 shows a polishing apparatus of the second embodiment. Those parts shown in FIGS. 6 and 7 which are structurally and functionally identical to or similar to those shown in FIGS. 3 and 5 are denoted at identical reference numerals, and explanation thereof will be omitted. In this embodiment, the cover 10 has substantially the same structure as the cover 10 in the first embodiment shown in FIG. 3. However, the cover 10 of the second embodiment is not provided with exhaust holes at the upper wall 11. The other structure of the cover 10 in FIG. 6 is the same as that of the cover 10 in FIG. 3. As shown in FIG. 7, an annular trough 97 is provided below the outer periphery of the turntable 73. A drain pipe 51 is connected to a bottom wall of the trough 97, and a pipe-like exhaust duct 53 is connected to a side wall of the trough 97. An upper end of the exhaust duct 53 is connected to an exhaust duct 55 extending upwardly. The exhaust duct 55 is connected to an exhaust duct (not shown) extending externally of the polishing apparatus 70. A waterproof pan 60 which partitions the interior of the polishing apparatus 70 into an upper chamber and a lower chamber extends horizontally from the side wall of the trough 97.

When the polishing apparatus 70 is in operation, negative pressure is developed in the exhaust ducts 53 and 55 due to an air stream generated by a fan (not shown) or the like. As shown in FIG. 7, since the gap between the lower surface of the turntable 73 and the trough 97 is small, when gas or air in the cover 10 is exhausted through the exhaust duct 53, air is introduced into the cover 10 through the holes 17 and 21. The air which flows in the cover 10 passes through the trough 97, and flows in the exhaust duct 53, and then is discharged through the exhaust duct 55 to the outside of the apparatus.

When the semiconductor wafer is polished, the abrasive liquid on the turntable 73 is scattered around. When the polishing cloth 74 is dressed, the dressing liquid such as a deionized water on the turntable 73 is also scattered around. However, the abrasive liquid or the dressing liquid is trapped by the cover 10, the trapped liquid drops into the trough 97, and is discharged through the drain pipe 51 to the exterior of the polishing apparatus 70.

On the other hand, mist generated in the cover 10 flows through the trough 97 into the exhaust duct 53, and is discharged through the exhaust duct 55 to the exterior of the polishing apparatus 70. Therefore, mist generated on the turntable 73 does not remain in the polishing apparatus 70, and is discharged therefrom to the exterior of the apparatus. That is, the liquid or mist in the cover 10 is discharged to the exterior of the apparatus without adversely affecting the various equipments including driving devices for the top ring and the dressing tool. When the cover 10 is removed for replacement of the polishing cloth 74 on the turntable 73, since no exhaust duct is connected to the cover 10, detachment or attachment of the exhaust duct is not required, and hence the maintenance of the turntable, such as replacement of the polishing cloth, can be easily performed.

As described above, according to the second embodiment of the present invention, the exhaust duct is connected to the trough disposed around the outer periphery of the turntable, and gas or air in the cover is exhausted through the trough and the exhaust duct connected to the trough. Therefore, when the cover is removed from the turntable or attached to the turntable, detachment or attachment of the exhaust duct is not required, and hence the maintenance of the turntable can be easily performed.

Figure 8:
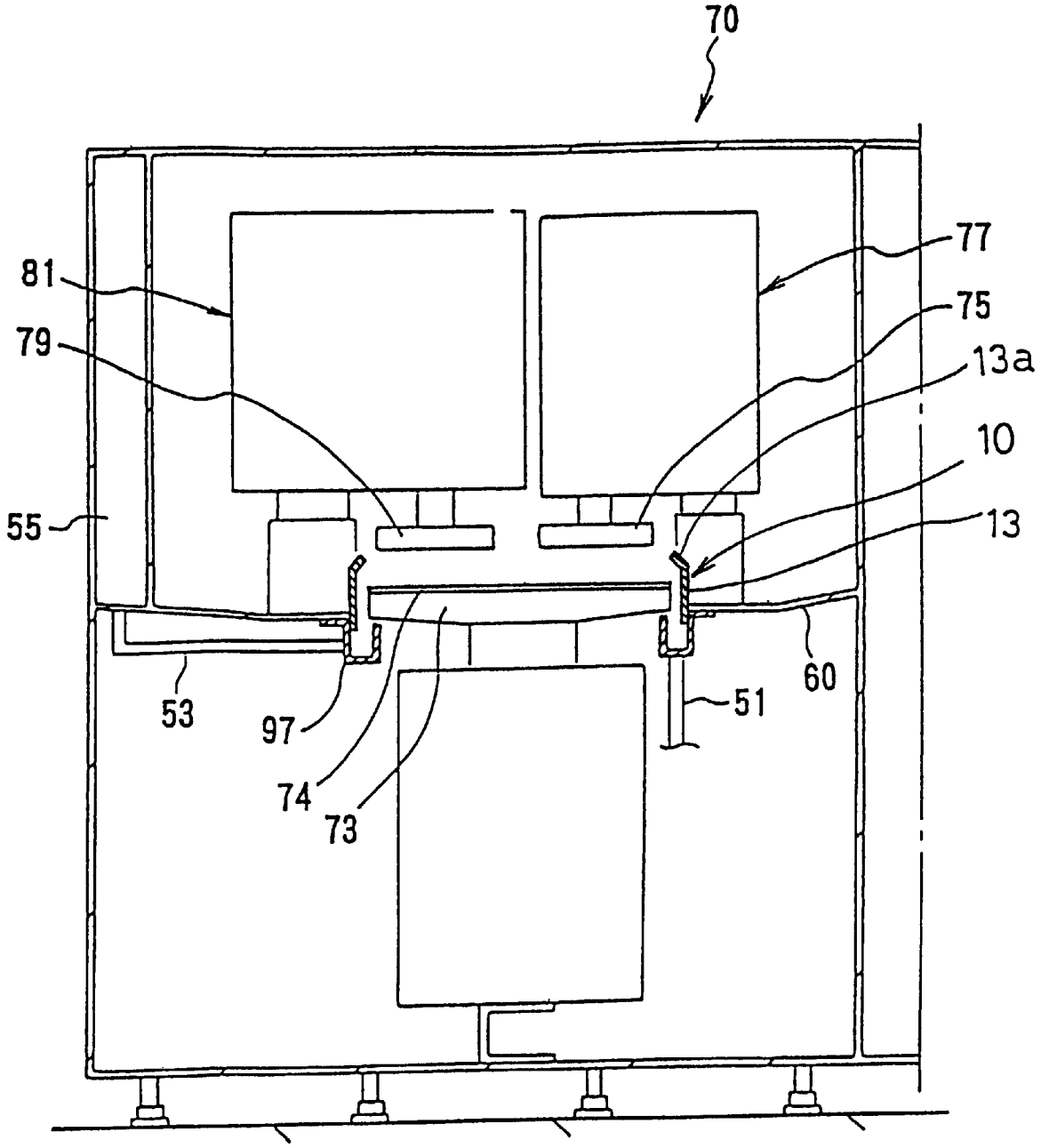
FIG. 8 is a vertical cross-sectional view of a polishing apparatus having a cover for a turntable according to a third embodiment of the present invention.

FIG. 8 shows a third embodiment of the present invention.

In the third embodiment, a cover 10 has a cylindrical side wall 13, but does not have an upper wall. The side wall 13 serves to prevent liquid on the turntable 73 from being scattered. The side wall 13 has an upper end portion 13*a* which is inclined inwardly.

The inner diameter of the upper end portion 13*a* is slightly larger than the outer diameter of the turntable 73. The cover 10 is vertically movable by a screw mechanism or the like so that the cover 10 can be lowered from the position shown in FIG. 8 when maintenance of the turntable 73, such as replacement of the polishing cloth, is performed. In this embodiment, the cover 10 is not required to be removed from the turntable 73 when the maintenance of the turntable or the like is carried out, because the cover 10 does not have an upper wall. Therefore, since the cover 10 is not placed outside the apparatus at the time of maintenance, any contaminant which adheres to the cover 10 is not scattered in the clean room in which the polishing apparatus is installed.

Further, in this embodiment, the dressing tool may comprise a nozzle or the like which supplies a high-pressure fluid such as liquid or air onto the polishing cloth 74.

Although certain preferred embodiments of the present invention has been shown and described in detail, it should be understood that various changes and modification may be made thereto without departing from the scope of the appended claims.

What is claimed is:

1. A polishing apparatus for polishing a surface of a workpiece, said apparatus comprising:

a turntable having a polishing surface;

a top ring for supporting the workpiece to be polished and pressing the workpiece against said polishing surface;

a side wall disposed around said turntable, for preventing liquid on said turntable from being scattered, said side wall being lowerable relative to said turntable when maintenance of said turntable is to be performed; and a device for lowering said side wall relative to said turntable when maintenance of said turntable is to be performed, wherein said device comprises a screw mechanism.

2. A polishing apparatus for polishing a surface of a workpiece, said apparatus comprising:

a turntable having a polishing surface;

a top ring for supporting the workpiece to be polished and pressing the workpiece against said polishing surface;

a side wall disposed around said turntable, for preventing liquid on said turntable from being scattered, said side wall being vertically movable relative to said turntable to enable maintenance of said turntable to be performed; and a device for vertically moving said side wall relative to said turntable to enable maintenance of said turntable to be performed, wherein said device comprises a screw mechanism.

* * * * *